US008052492B2

(12) United States Patent
Drew et al.

(10) Patent No.: US 8,052,492 B2
(45) Date of Patent: Nov. 8, 2011

(54) MULTI-LEVEL ELECTRICAL TERMINAL CRIMP

(75) Inventors: George Albert Drew, Warren, OH (US); William J. Palm, Warren, OH (US); Bruce S. Gump, Warren, OH (US); Mark David Baranski, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 103 days.

(21) Appl. No.: 12/291,813

(22) Filed: Nov. 13, 2008

(65) Prior Publication Data

US 2010/0120288 A1 May 13, 2010

(51) Int. Cl.
*H01R 4/18* (2006.01)

(52) U.S. Cl. ..... 439/882

(58) Field of Classification Search ..... 439/862, 439/852, 874, 879, 866; 174/84 C, 94 R; 219/121.64

See application file for complete search history.

(56) References Cited

U.S. PATENT DOCUMENTS

| | | | | |
|---|---|---|---|---|
| 2,815,497 | A | 12/1957 | Redslob | |
| 3,275,738 | A | 9/1966 | Flynn et al. | |
| 3,408,450 | A | 10/1968 | Kleinfelder | |
| 3,539,709 | A | 11/1970 | Brancaleone | |
| 3,828,305 | A | 8/1974 | Hogendobler | |
| 3,953,103 | A * | 4/1976 | Mathis | 439/866 |
| 3,956,823 | A * | 5/1976 | Kuo | 29/863 |
| 4,336,977 | A | 6/1982 | Monaghan et al. | |
| 4,693,550 | A | 9/1987 | Borwn et al. | |
| 5,141,451 | A | 8/1992 | Down | |
| 5,422,438 | A | 6/1995 | Lamome | |
| 5,425,662 | A * | 6/1995 | Villeneuve | 439/882 |
| 5,772,454 | A * | 6/1998 | Long, Jr. | 439/83 |
| 7,705,265 | B2 * | 4/2010 | Asakura et al. | 219/121.64 |

* cited by examiner

*Primary Examiner* — Alexander Gilman
(74) *Attorney, Agent, or Firm* — Thomas N. Twomey

(57) ABSTRACT

A cable assembly includes a terminal crimped to a conductor. The terminal has a plurality of crimps spaced from one another and a transition crimp disposed therebetween. A method includes deforming the terminal about the conductor to define the plurality of crimps having different crimp heights, and deforming the terminal about the conductor to define the transition crimp between each of the plurality of crimps. The transition crimp has a crimp height different than each of the plurality of crimps.

18 Claims, 1 Drawing Sheet

MULTI-LEVEL ELECTRICAL TERMINAL CRIMP

BACKGROUND

Electrical devices are commonly connected together using some type of electrical cable assembly that includes an electrical conductor (such as conductor or coax cable assembly) and a conductive terminal. The terminals are generally metal tubes or a U-shaped metal that is squeezed around the conductor. The crimping action effectively reforms the terminal around the conductor to form a strong electrical and physical connection. Often, the reliability of the electrical device depends in part on the quality of the connection created between the terminal and the conductor (i.e., the "crimp"). Thus, crimping not only provides for electrical connectivity, but also provides a mechanical connection for protection against torsional and tensional forces. These forces can damage the terminal or the conductor and disrupt the electrical connection.

Most commonly, crimped connections have been used to attach copper conductors to terminals. However, due to the lower cost and weight of aluminum, conductors formed from aluminum or aluminum alloys are becoming a prevalent alternative to copper. The same types of crimped connections that are commonly used for copper, however, don't always perform well with aluminum-based materials because of the corrosive products that accumulate on the surface of the terminal and/or conductor that can impede the electrical connection and weaken the physical connection.

Known crimp-style connections tend to use the force or pressure of the crimping action alone to make the electrical and mechanical connections between the terminal and the conductor. This force, however, tends to damage or break either the conductor or the terminal. If less crimping force is used to prevent damage or breakage, the electrical or mechanical connections may not be adequate for the needs of the system. Moreover, creating an effective electrical connection between the terminal and the conductor using a pressure contact method is impeded by various corrosion products on the surface of the terminal and the conductor.

Various methods have been employed to overcome these impediments, but few have been successful in high volume manufacturing environments. Making an electrically stable contact with the conductor for long periods of time and over many different environmental factors generally includes overcoming surface corrosion on both the conductor and the terminal by breaking through corrosion products to expose non-corroded portions of the conductor, removing the corrosion products on the surface of the terminal, and electrically connecting the non-corroded portions of the conductor and terminal to one another in a manner that will be physically stable over time, temperature, and other environmental changes. This type of connection is especially difficult when aluminum conductor is used due to the low hardness of the aluminum combined with corrosion products on the aluminum, which are often much harder than the aluminum itself.

Thus, there is a need for a connector that provides a firm electrical and mechanical connection without causing damage or breakage to the conductor and/or terminal, and can overcome connection impediments due to corrosion.

BRIEF SUMMARY

A cable assembly includes a terminal crimped to a conductor. The terminal has a plurality of crimps spaced from one another and a transition crimp disposed therebetween.

A method includes deforming the terminal about the conductor to define the plurality of crimps having different crimp heights, and deforming the terminal about the conductor to define the transition crimp between each of the plurality of crimps. The transition crimp has a crimp height different than each of the plurality of crimps.

DETAILED DESCRIPTION

A cable assembly includes a terminal crimped to a conductor, such as a wire. The terminal has a plurality of crimps spaced from one another and a transition crimp disposed therebetween. One of the crimps is tighter against the conductor and maximizes the electrical connection between the conductor and the terminal. Another of the crimps maximizes the pull-out strength of the conductor. However, an abrupt change in crimp heights between these two crimps may actually reduce the electrical and/or physical connection between the conductor and the terminal. Therefore, the transition crimp minimizes the impact of the abrupt change in crimp heights between the plurality of crimps, thus allowing the conductor to have a strong electrical and physical connection to the terminal. A crimping tool is used to form the cable assembly and form the plurality of crimps and transition crimp. The crimping tool deforms the terminal about the conductor to define the plurality of crimps and the transition crimp between each of the plurality of crimps such that the transition crimp and each of the plurality of crimps have different crimp heights.

Figure 1:
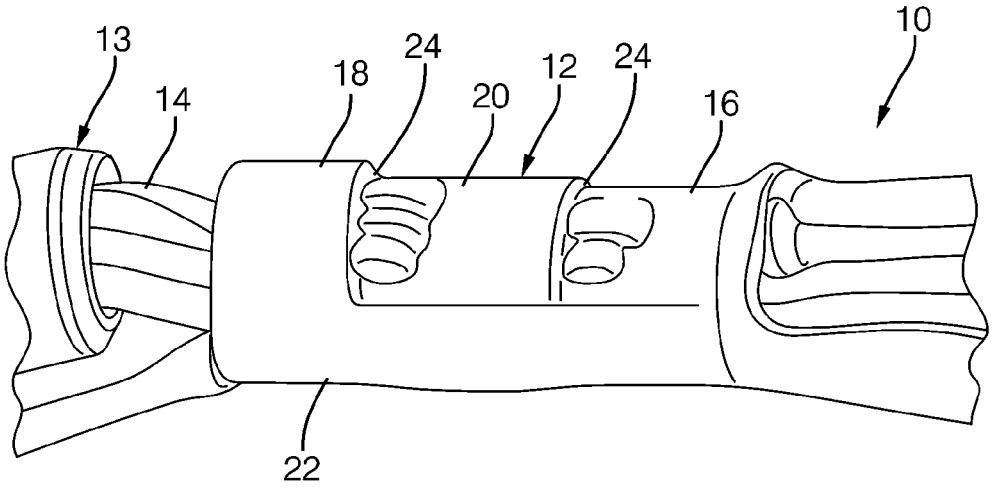
FIG. 1 is a perspective view of an exemplary cable assembly having multi-stage crimps, according to an embodiment.

FIG. 1 is a perspective view of an exemplary cable assembly 10 having consecutively adjoined, multi-stage crimps 16, 18, 20. In one exemplary approach, the cable assembly 10 includes a wire cable 13 having a conductor 14 and a terminal 12. Terminal 12 includes a base 22 spaced apart from crimps 16, 18, 20. Conductor 14 extends from wire cable 13 and is disposed in terminal 12 and terminal 12 is then crimped to conductor 14, such as a wire. In other words, the terminal 12 is deformed about the wire conductor 14 to provide a strong physical and electrical connection to the wire conductor 14. The terminal 12 has plurality of crimps 16, 18, 20 adjacently spaced one-to-another. Specifically, the terminal 12 defines at least a first crimp 16 and a second crimp 18. Moreover, the terminal 12 defines a transition crimp 20 disposed between first crimp 16 and second crimp 18 in plurality of crimps 16, 18, 20.

The conductor 14 may be formed from various materials, including aluminum or aluminum-based materials. Because aluminum or aluminum-based conductors may develop oxide coatings, a tight crimp is often needed to form a strong electrical connection. Accordingly, the first crimp 16 is tighter about the conductor 14 than the second crimp 18 and the transition crimp 20 to remove the oxide coating and effectively maximize an electrical contact between the conductor 14 and the terminal 12. Although tightly crimping the terminal 12 to the conductor 14 may increase the electrical contact, it may also reduce the physical connection between the terminal 12 and the conductor 14. A reduced physical connection means that the conductor 14 is able to be pulled out from the terminal 12 more easily. In other words, the first crimp 16 may decrease the pull-out strength of the conductor 14. Therefore, in one exemplary approach, the second crimp 18 is looser than the first crimp 16. This way, the first crimp 16 maximizes the electrical contact between the terminal 12 and the conductor 14, while the second crimp 18 effectively maximizes the pull-out strength of the conductor 14 from the terminal 12. The combination of the first crimp 16 and the second crimp 18 allow the terminal 12 to have a strong physical and electrical connection to the conductor 14.

Because the first crimp 16 is tighter on the wire conductor 14 than the second crimp 18, the first crimp 16 has a crimp height that is smaller than a crimp height of the second crimp 18. In one embodiment, the crimp height of the first crimp is 0.35 mm smaller than the crimp height of the second crimp. It is to be appreciated that such an abrupt change in crimp height may actually reduce the electrical and/or physical connection of the conductor 14 to the terminal 12. In other words, the large difference in crimp heights may weaken the electrical connection and/or the pull-out strength of the conductor 14 relative to the terminal 12. Therefore, the transition crimp 20 in combination with abrupt change transitions 24 are provided to allow a large difference in crimp heights between the first crimp 16 and the second crimp 18 without sacrificing the electrical and/or physical connection of the conductor 14 to the terminal 12. The first crimp 16 is tighter on the conductor 14 than the transition crimp 20, and the transition crimp 20 is tighter on the conductor 14 than the second crimp 18. Therefore, the transition crimp 20 has a crimp height that is configured to provide a transition between the first crimp 16 and the second crimp 18. In one exemplary approach, the height of the transition crimp is less than 0.35 mm larger than the first crimp 16, and less than 0.35 mm smaller than the second crimp.

Figure 2:
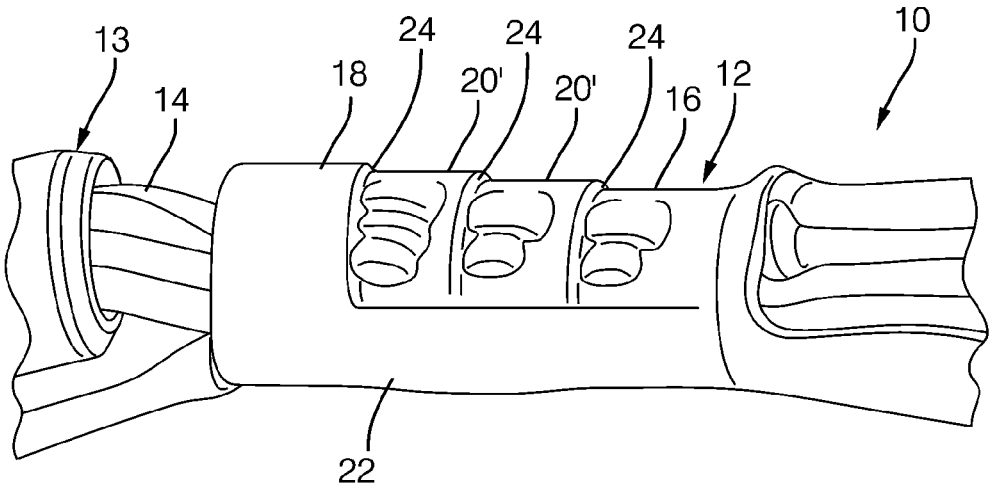
FIG. 2 is a perspective view of a cable assembly having multi-stage crimps that includes a plurality of transition crimps, according to an alternate embodiment.

It is to be appreciated that the first crimp 16, the second crimp 18, and the transition crimp 20 may be integrally formed with the terminal 12. Also, referring to FIG. 2, it is to be appreciated that the terminal 12 may include any number of crimps spaced from one another with additional transition crimps 20' disposed therebetween. Furthermore, it is to be appreciated that the terminal 12 having the first crimp 16, the second crimp 18, and the transition crimp 20 as described herein may meet various industry quality standards, such as standards set forth by the United States Council for Automotive Research (USCAR), among others. For example, the cable assembly 10 disclosed herein may meet the requirements for USCAR21, which is a crimp validation specification, and USCAR20, which is a field correlated life test.

A crimping tool (not shown) may be used to deform the terminal 12 about the wire conductor 14 to form the first crimp 16 and the second crimp 18, and specifically, to crimp the terminal 12 so that each crimp has a different crimp height. Moreover, the crimping tool may deform the terminal 12 about the conductor 14 to define the transition crimp 20 between the first crimp 16 and the second crimp 18. As a result, the cable assembly 10 includes the terminal 12 where the first crimp 16, the second crimp 18, and the transition crimp 20 each have different crimp heights. In order to form the different crimp heights, the crimping tool may crimp the terminal 12 such that the first crimp 16 is tighter than the second crimp 18 and the transition crimp 20, and the transition crimp 20 is tighter on the conductor 14 than the second crimp 18. The crimping tool may be configured or shaped such that the first crimp 16, the second crimp 18, and the transition crimp 20 are formed simultaneously. In other words, the terminal 12 may be deformed in a single action by the crimping tool, instead of being deformed in two or more separate crimping actions. Moreover, it is appreciated that the crimping tool may deform the terminal 12 to have more than two crimps, with each crimp having a transition crimp 20 therebetween. Accordingly, referring to FIG. 2, the crimping tool may form any number of crimps and transition crimps 20' in the terminal 12.

Although the terminal 12 is shown as a double-notch terminal (i.e., the terminal 12 has two "windows" at the top of the crimp), the terminal 12 may instead have zero, one, or any other number of notches.

The above description is intended to be illustrative and not restrictive. Many alternative approaches or applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

The present embodiments have been particularly shown and described, which are merely illustrative of the best modes. It should be understood by those skilled in the art that various alternatives to the embodiments described herein may be employed in practicing the claims without departing from the spirit and scope as defined in the following claims. It is intended that the following claims define the scope of the invention and that the method and apparatus within the scope of these claims and their equivalents be covered thereby. This description should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

We claim:

1. A cable assembly comprising:

a wire cable including a wire conductor; and a terminal including a base and having a portion of the wire conductor received in the terminal adjacent the base so that at least three consecutively adjoined crimps of the terminal surround the wire conductor in a manner that electrically and mechanically attach the wire conductor to the terminal, wherein each crimp in the at least three consecutively adjoined crimps has a length and a generally constant height along the respective lengths of the at least three consecutively adjoined crimps, the respective constant heights being in relation to the base of the terminal that is spaced apart from the at least three consecutively adjoined crimps.

2. The cable assembly of claim 1, wherein the at least three consecutively adjoined crimps include a first adjoined crimp, a second adjoined crimp, and a third adjoined crimp, said third adjoined crimp being a transition crimp disposed intermediate the second and the first crimp, and the second crimp being disposed along the wire conductor remote from an end of the wire conductor more than the first crimp and the third crimp.

3. The cable assembly as set forth in claim 2, wherein the first crimp among said plurality of consecutively adjoined crimps maximizes an electrical contact between said conductor and said terminal.

4. The cable assembly as set forth in claim 2, wherein the second crimp among said plurality of consecutively adjoined crimps maximizes a pull-out strength of said conductor from said terminal.

5. The cable assembly as set forth in claim 2, wherein the first crimp of said plurality of consecutively adjoined crimps is tighter on said conductor than the second crimp and the transition crimp.

6. The cable assembly as set forth in claim 5, wherein the first crimp of said plurality of consecutively adjoined crimps is tighter on said conductor than said transition crimp, and said transition crimp is tighter on said conductor than said second crimp.

7. The cable assembly as set forth in claim 1, wherein said wire conductor is formed of one of, (i) aluminum, and (ii) an aluminum-based material.

8. The cable assembly of claim 1, wherein each respective constant height of the at least three consecutively adjoined crimps is a different constant height.

9. The cable assembly of claim 8, wherein said respective constant heights of the at least three consecutively adjoined crimps increase in height moving away from an end of the wire conductor towards the wire cable.

10. The cable assembly of claim 8, wherein the at least three consecutively adjoined crimps include, at least one transition crimp disposed intermediate other crimps in the at least three consecutively adjoined crimps, and at least two abrupt change transitions that respectively transition the at least one transition crimp to other crimps in the at least three consecutively adjoined crimps.

11. The cable assembly of claim 10, wherein the at least one transition crimp comprises a plurality of transition crimps, the plurality of transition crimps being disposed between other crimps in the at least three consecutively adjoined crimps.

12. A method to construct an electrical contact between a terminal and a wire conductor, comprising:

deforming the terminal about the wire conductor to define a plurality of consecutively adjoined crimps where each of the respective crimps has a generally constant height in relation to a base of the terminal, the plurality of consecutively adjoined crimps further include at least one transition crimp being disposed intermediate the other crimps in the plurality of consecutive adjoined crimps having different crimp.

13. The method as set forth in claim 12, wherein the step of deforming the terminal further includes the wire conductor being formed of one of, (i) aluminum, and (ii) an aluminum-based material.

14. The method as set forth in claim 12, wherein the step of deforming the terminal further includes the plurality of consecutively adjoined crimps having a first crimp and a second crimp and a third crimp, said third crimp being a transition crimp disposed intermediate the second crimp and the first crimp, and the second crimp being disposed along the wire conductor remote from an end of the wire conductor more than the first crimp and the third crimp.

15. The method as set forth in claim 14, wherein the step of deforming the terminal further includes, maximizing an electrical contact between the wire conductor and the terminal at the first crimp.

16. The method as set forth in claim 14, wherein the step of deforming the terminal further includes, maximizing a pull-out strength of the wire conductor from the terminal at the second crimp.

17. The method as set forth in claim 14, wherein the step of deforming the terminal further includes making the first crimp tighter against the wire conductor than the transition crimp and the second crimp.

18. The method as set forth in claim 17, wherein the step of deforming the terminal further includes making the first crimp tighter against the wire conductor than the transition crimp, and making said transition crimp tighter on said wire conductor than said second crimp.

* * * * *